US008424966B1

(12) United States Patent
May

(10) Patent No.: US 8,424,966 B1
(45) Date of Patent: Apr. 23, 2013

(54) SEATING WITH ECCENTRIC SWIVEL

(75) Inventor: Teddy J. May, Mooreville, MS (US)

(73) Assignee: Lane Furniture Industries, Inc., Tupelo, MS (US)

( * ) Notice: Subject to any disclaimer, the term of this patent is extended or adjusted under 35 U.S.C. 154(b) by 310 days.

(21) Appl. No.: 12/876,442

(22) Filed: Sep. 7, 2010

Related U.S. Application Data

(60) Provisional application No. 61/272,311, filed on Sep. 8, 2009.

(51) Int. Cl.
*A47C 15/00* (2006.01)
*A47C 1/00* (2006.01)

(52) U.S. Cl.
USPC .. 297/249; 297/240; 297/344.22; 297/344.26

(58) Field of Classification Search ..... 297/344.21, 297/344.26, 344.22, 344.24, 257, 68, 240, 297/249
See application file for complete search history.

(56) References Cited

U.S. PATENT DOCUMENTS

| | | | | |
|---|---|---|---|---|
| 1,250,155 | A | 12/1917 | Emond | |
| 1,903,267 | A * | 3/1933 | Roberts | 248/417 |
| 2,822,858 | A | 2/1958 | Mussler | |
| 2,958,369 | A | 11/1960 | Pitts et al. | |
| 2,992,852 | A | 7/1961 | Loofbourrow et al. | |
| 3,013,837 | A | 12/1961 | Pessl et al. | |
| 3,066,979 | A | 12/1962 | Pitts et al. | |
| 3,104,911 | A | 9/1963 | James et al. | |
| 4,662,679 | A * | 5/1987 | Franck et al. | 297/240 |
| 4,798,361 | A | 1/1989 | Fawcett | |
| 5,064,244 | A * | 11/1991 | Sproule | 297/68 |
| 5,474,353 | A | 12/1995 | Koester | |
| D366,770 | S * | 2/1996 | Mabon | D6/336 |
| 6,027,170 | A | 2/2000 | Benz et al. | |
| 6,241,314 | B1 | 6/2001 | Pufall | |
| 6,981,746 | B2 | 1/2006 | Chung et al. | |
| 7,159,940 | B1 | 1/2007 | Atkins | |
| 7,204,554 | B2 | 4/2007 | Wieclawski | |
| 7,219,961 | B2 | 5/2007 | Priepke et al. | |
| 7,364,234 | B2 | 4/2008 | Begin et al. | |
| 7,438,339 | B2 | 10/2008 | Abraham | |
| 7,472,958 | B2 | 1/2009 | Sano et al. | |
| 2003/0189364 | A1 | 10/2003 | Friedman | |
| 2010/0052392 | A1* | 3/2010 | Lung et al. | 297/344.24 |

FOREIGN PATENT DOCUMENTS

| | | |
|---|---|---|
| FR | 2695886 | 3/1994 |
| JP | 6092169 | 4/1994 |
| JP | 6292618 | 10/1994 |

* cited by examiner

*Primary Examiner* — Milton Nelson, Jr.
(74) *Attorney, Agent, or Firm* — Kilpatrick Townsend & Stockton LLP

(57) ABSTRACT

Described herein are embodiments of seating with an eccentric swivel that pivots to change the orientation of that seat. The seating with an eccentric swivel includes an eccentric pivot and other support structures that stabilize the seat as it pivots.

32 Claims, 19 Drawing Sheets

SEATING WITH ECCENTRIC SWIVEL

CROSS REFERENCE TO RELATED APPLICATIONS

This application claims the benefit of U.S. Provisional Application No. 61/272,311, filed Sep. 8, 2009 for "Seating with Eccentric Swivel," the entire contents of which are incorporated herein by this reference.

RELATED FIELDS

Furniture, such as sectional sofas or other multi-seat furniture, that incorporates at least one seat that pivots in an eccentric manner to change the orientation of that seat.

BACKGROUND

Arrangement of seating in a room is usually determined by how that furniture will be used. For instance, in a living room, sofas, chairs and other furniture may be placed to facilitate conversation among the persons sitting in the living room, or may be placed around a central point of interest in the room, such as a fireplace or television. However, sometimes the best arrangement of furniture for one purpose is not necessarily the best for other purposes. Furniture arranged for conversation may not allow comfortable viewing of the television from all of the seats, and some persons may be required to sit in uncomfortable positions in their seats if they want to watch the television.

It is known to incorporate a swivel mechanism into seating, such as a chair or recliner, to allow the user to rotate and adjust its orientation. U.S. Pat. No. 3,815,954, issued to Rogers et al. for a "Rocker Recliner Chair," shows a chair that incorporates a swivel plate assembly that allows the chair to rotate on its base. The swivel plate assembly shown in the Rogers patent is typical of known swivel mechanisms used in furniture.

These known swivel mechanisms are not suitable for all types of seating. For instance, these known swivel mechanisms are not suitable for use with certain multi-seat furniture designs, such as certain sectional sofa designs. One issue of particular importance when incorporating a swiveling seat into certain designs of multi-seat piece of furniture is ensuring that there will be suitable clearance between the swiveling seat and the other parts of the furniture. Known swivel mechanisms are not always suitable for providing swiveling capability to components of a multi-seat piece of furniture because of these clearance issues. Another issue of importance is maintaining seat balance as the swiveling seat moves through its range of motion where the pivot is offset from the center of the seat. Known swivel mechanisms do not always provide adequate balancing support for the seat.

BRIEF SUMMARY

Applicant has developed new and unique swivel mechanisms for furniture and furniture incorporating such mechanisms. These new swivel mechanisms pivot eccentrically to provide clearance between the pivotable seat and other parts of the furniture or other structures. In some embodiments, the outer geometries of the pivotable seat and other parts of the furniture may also be optimized to provide clearance throughout the seat's range of motion. In some embodiments, the eccentric pivot mechanism has a locking switch, allowing for the seat to be secured in a desired orientation. In some embodiments the furniture includes a support mechanism that supports the seat as it pivots eccentrically. In some embodiments the furniture has a reclining seat. In some embodiments seat can be incorporated in sectional sofas and other types of furniture.

DETAILED DESCRIPTION OF THE DRAWINGS

Figure 1:
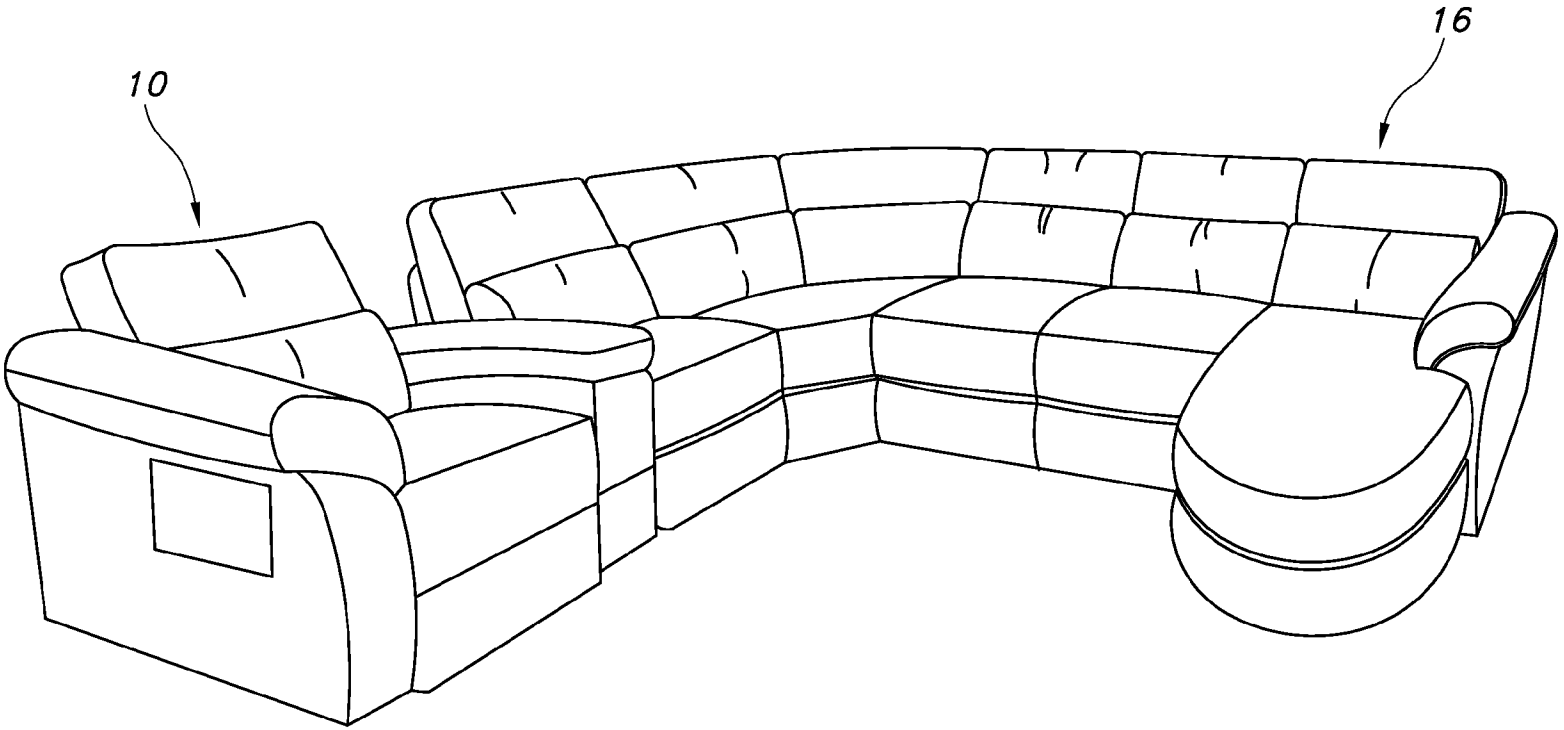
FIG. 1 illustrates an example of a sectional sofa that includes a seat that can eccentrically pivot and recline.
Figure 2:
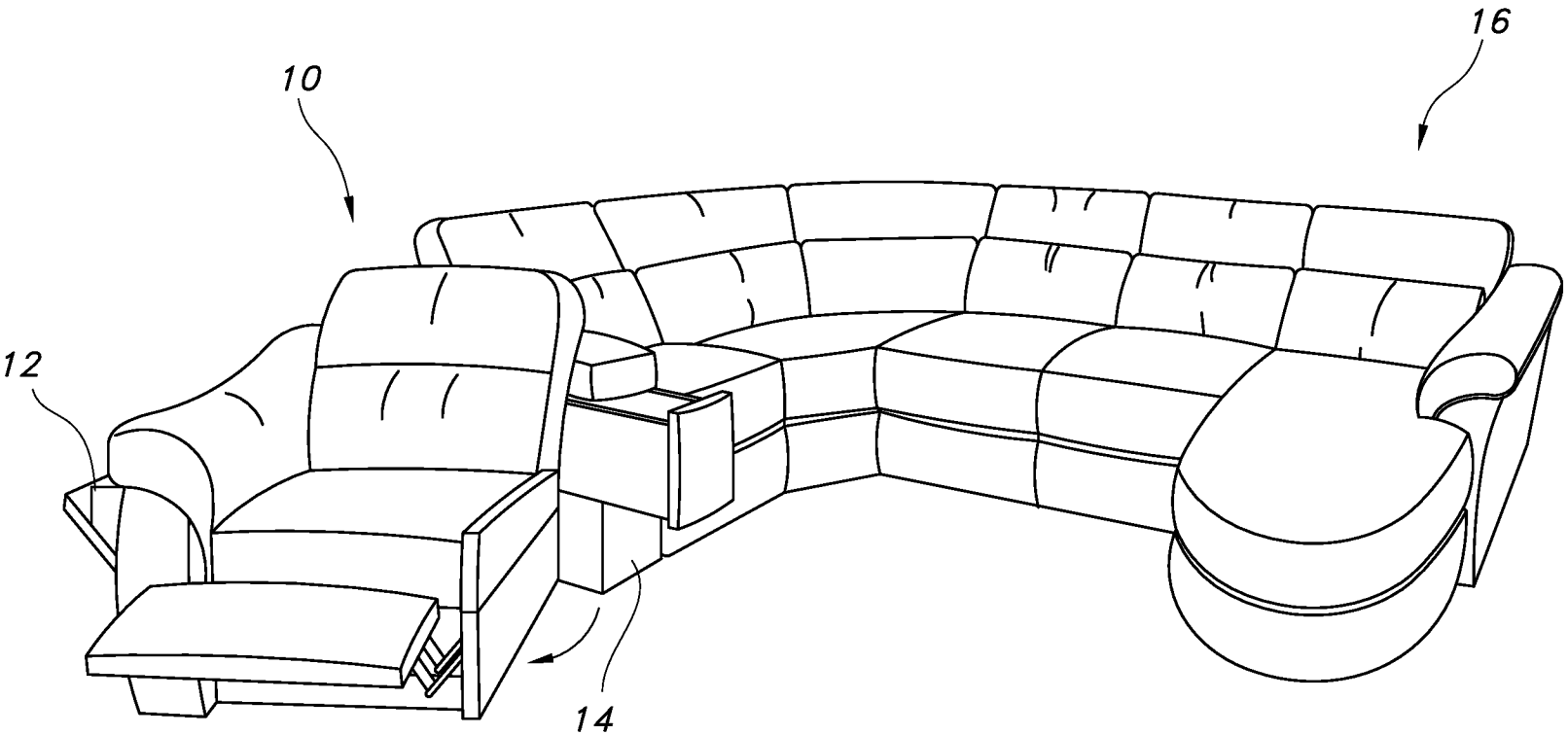
FIG. 2 illustrates the sectional sofa of FIG. 1 where the seat has been pivoted and is in a reclined position.

FIGS. 1 and 2 illustrate a sectional sofa that includes a seat 10 that can eccentrically pivot between an orientation in which the seat 10 is aligned with the adjacent seating (as shown in FIG. 1) and alternative orientations in which the seat 10 is not aligned with the adjacent seating (such as the orientation shown in FIG. 2). The seat 10 shown in FIG. 2 has pivoted approximately 35-45 degrees outward from the adjacent seating. Pivoting seat 10 to the position shown in FIG. 2 may place the seat 10 in a better position for viewing television or other points of interest in the room than the position of seat 10 shown in FIG. 1. As shown in FIG. 2, when pivoted, seat 10 is more closely aligned with the orientation of other seating of the sectional sofa, such as seat 16, than the seating adjacent to seat 10. As also shown in FIG. 2, seat 10 includes other optional feature, such as recliner functionality, a flip-out table 12, and a storage console 14.

Figure 3:
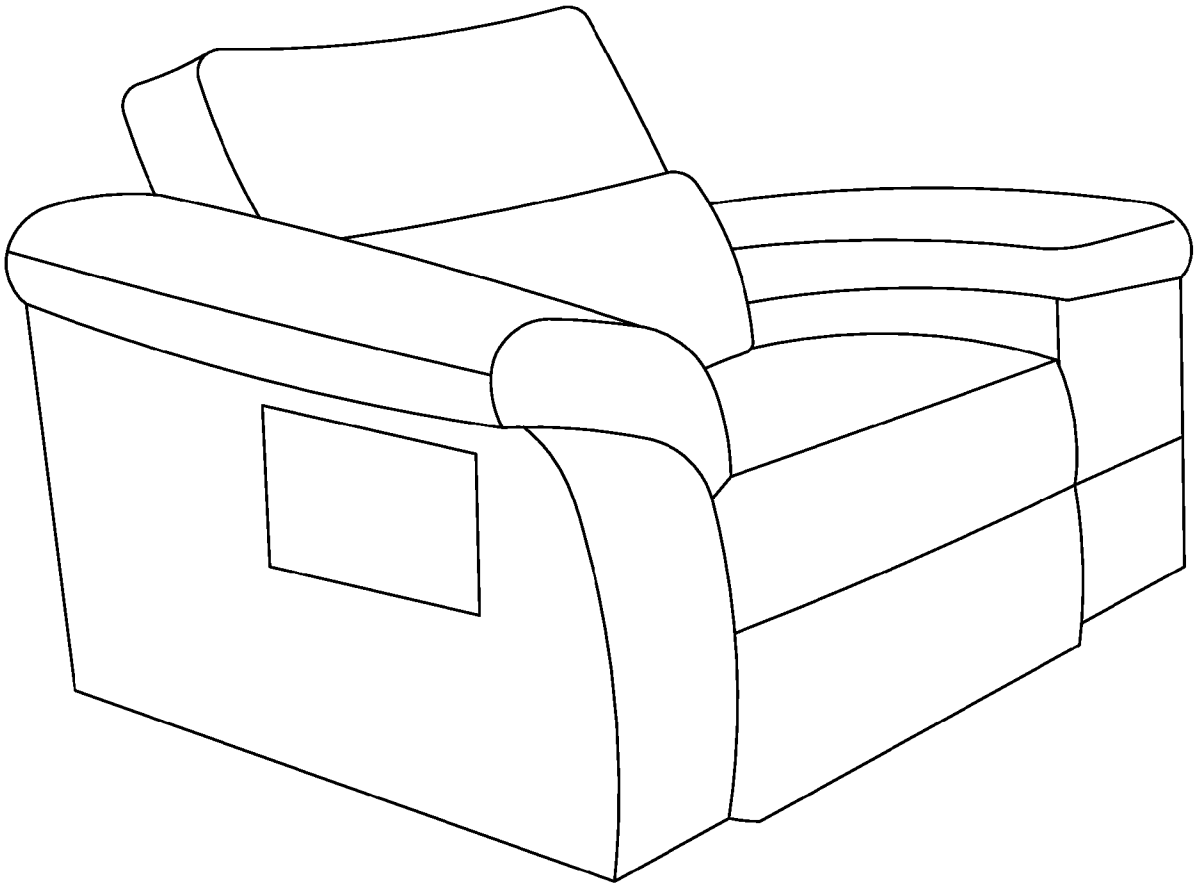
FIG. 3 shows one example of a seat of a sectional sofa.

FIG. 3 shows one example of an upholstery detail for a seat 10, although other ornamental designs are also possible.

Figure 4:
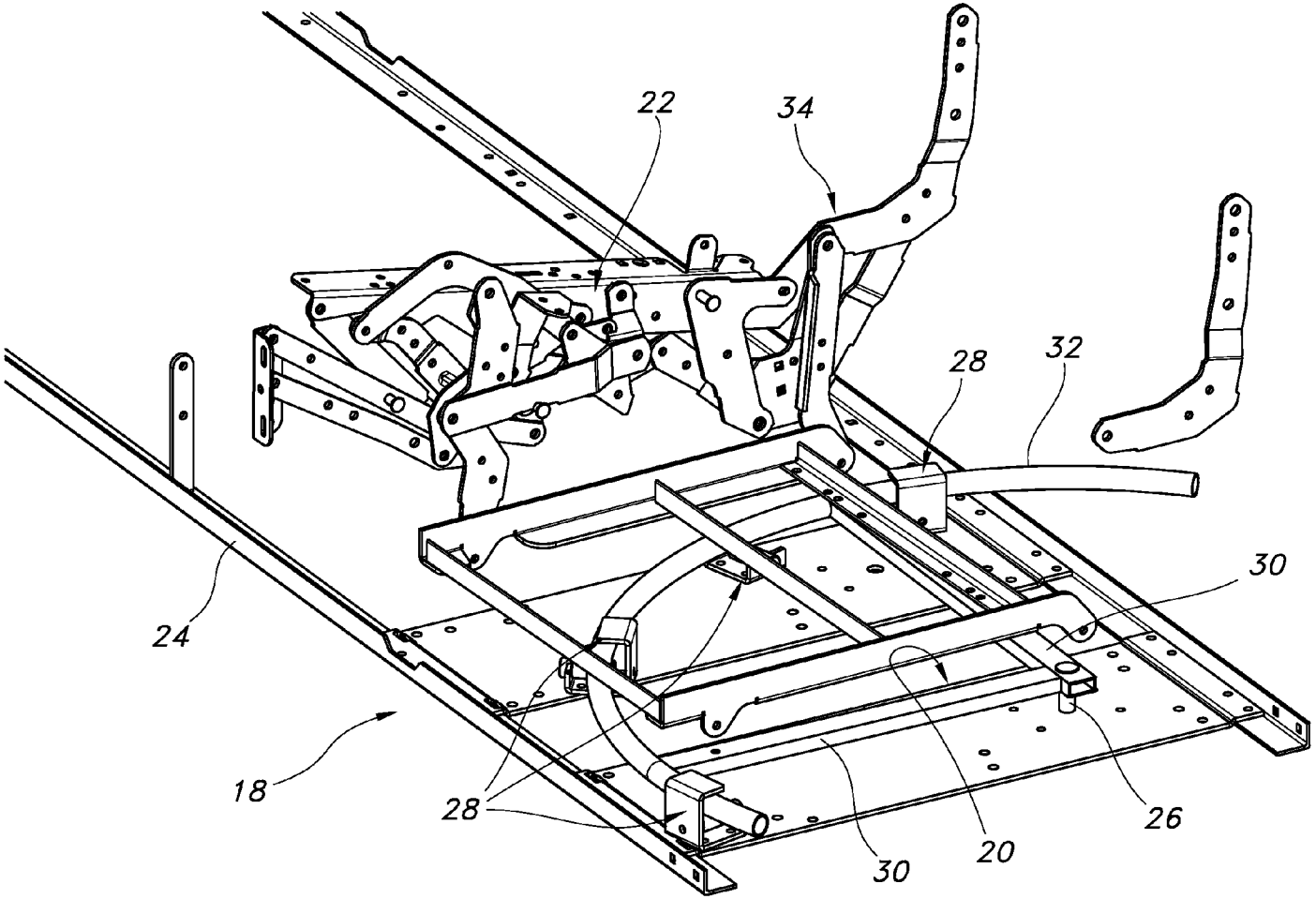
FIG. 4 shows one example of portions of an eccentric pivot mechanism for seating.
Figure 5:
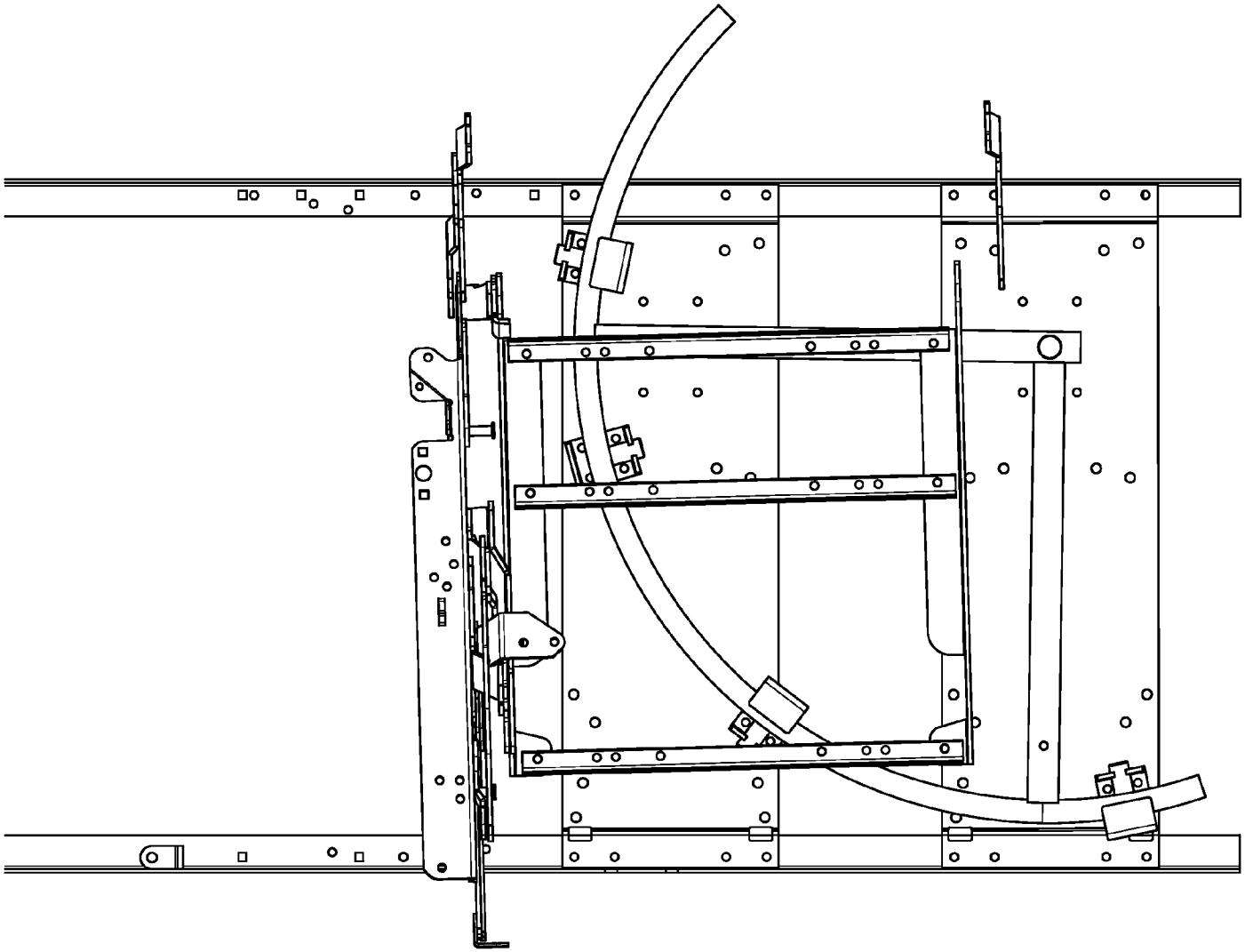
FIG. 5 shows another view of the pivot mechanism of FIG. 4, illustrating a partial range of motion of the mechanism.
Figure 6:
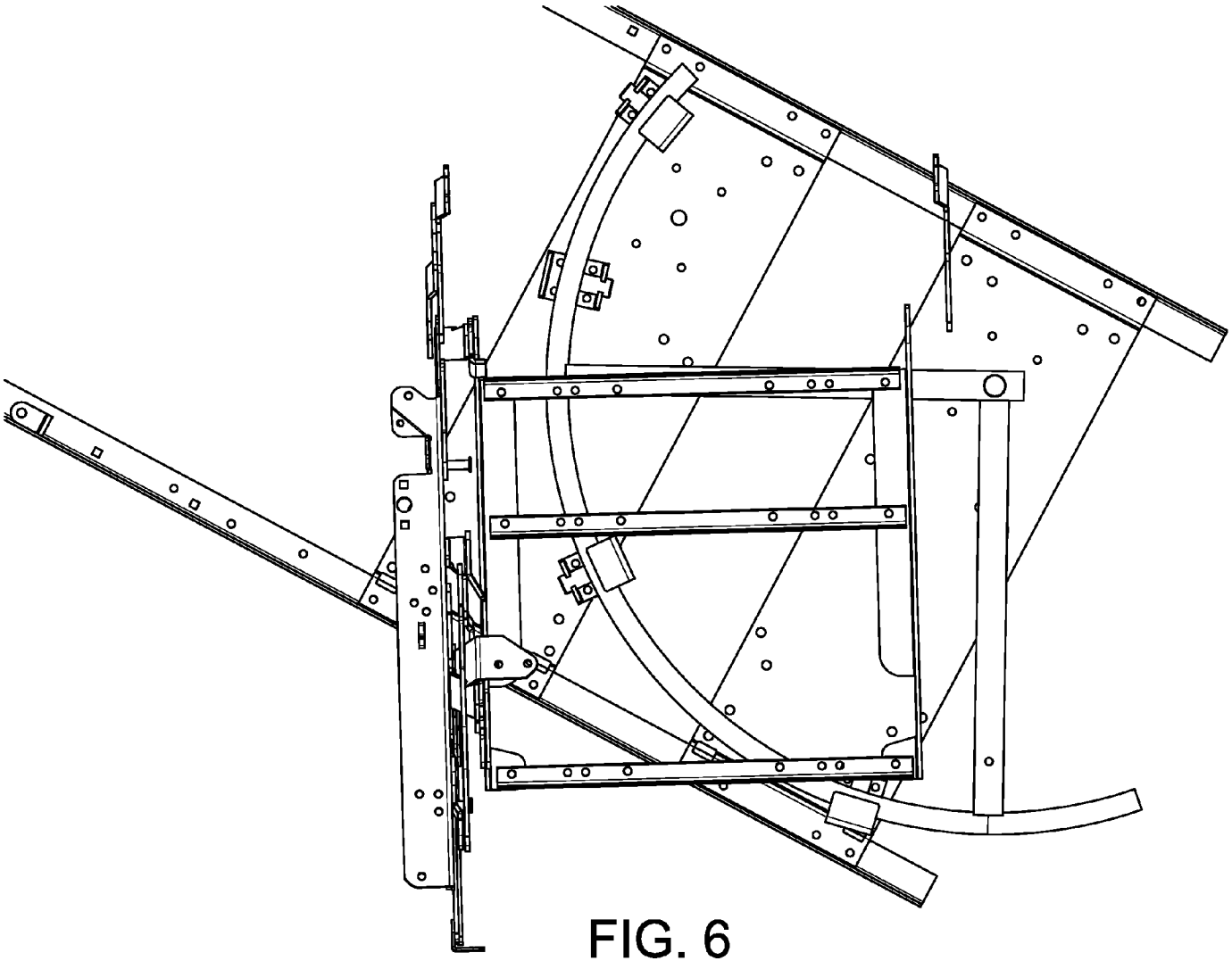
FIG. 6 shows another view of the pivot mechanism of FIG. 4, illustrating a partial range of motion of the mechanism.
Figure 7:
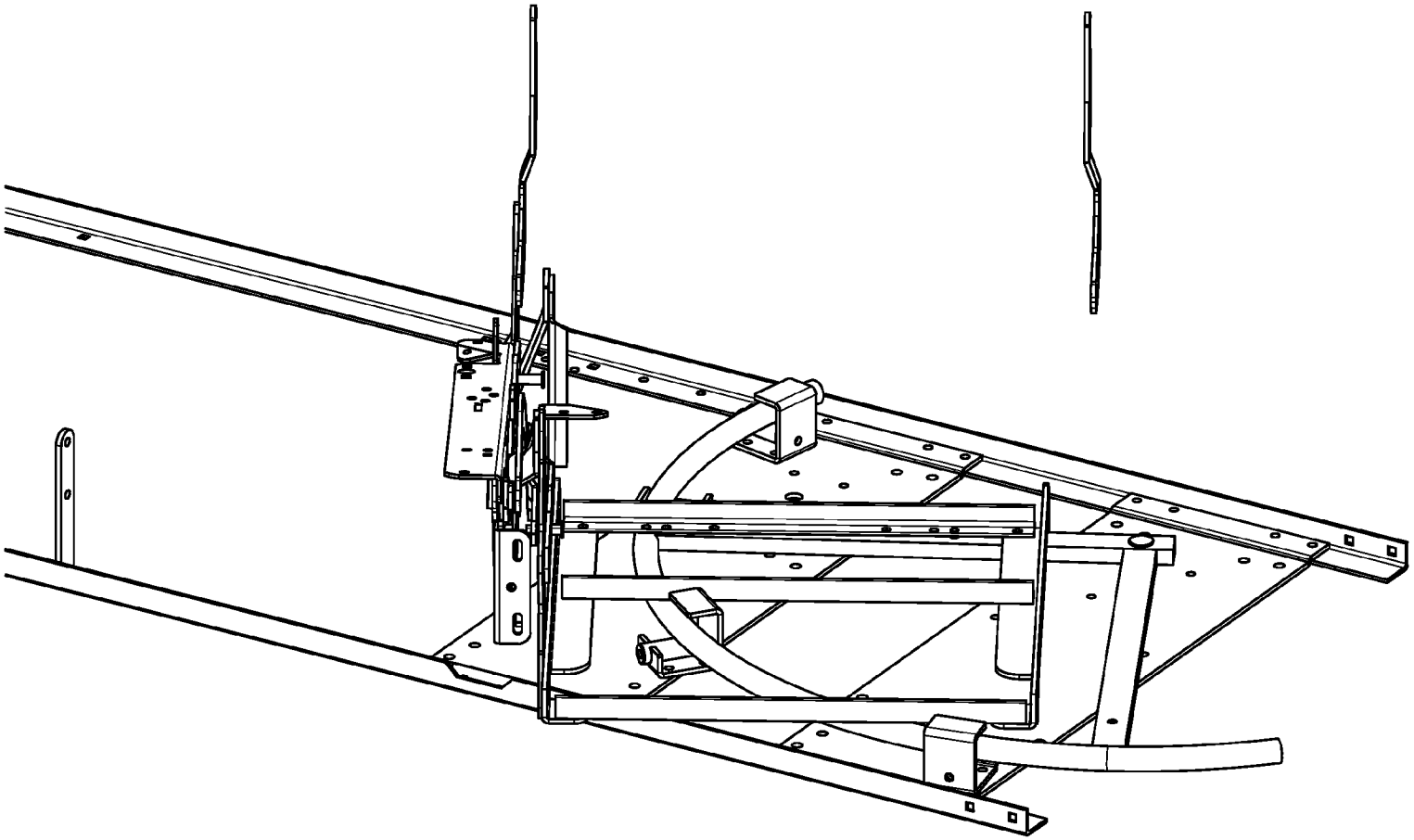
FIG. 7 shows another view of the pivot mechanism of FIG. 4, illustrating the mechanism in a reclined position.
Figure 8:
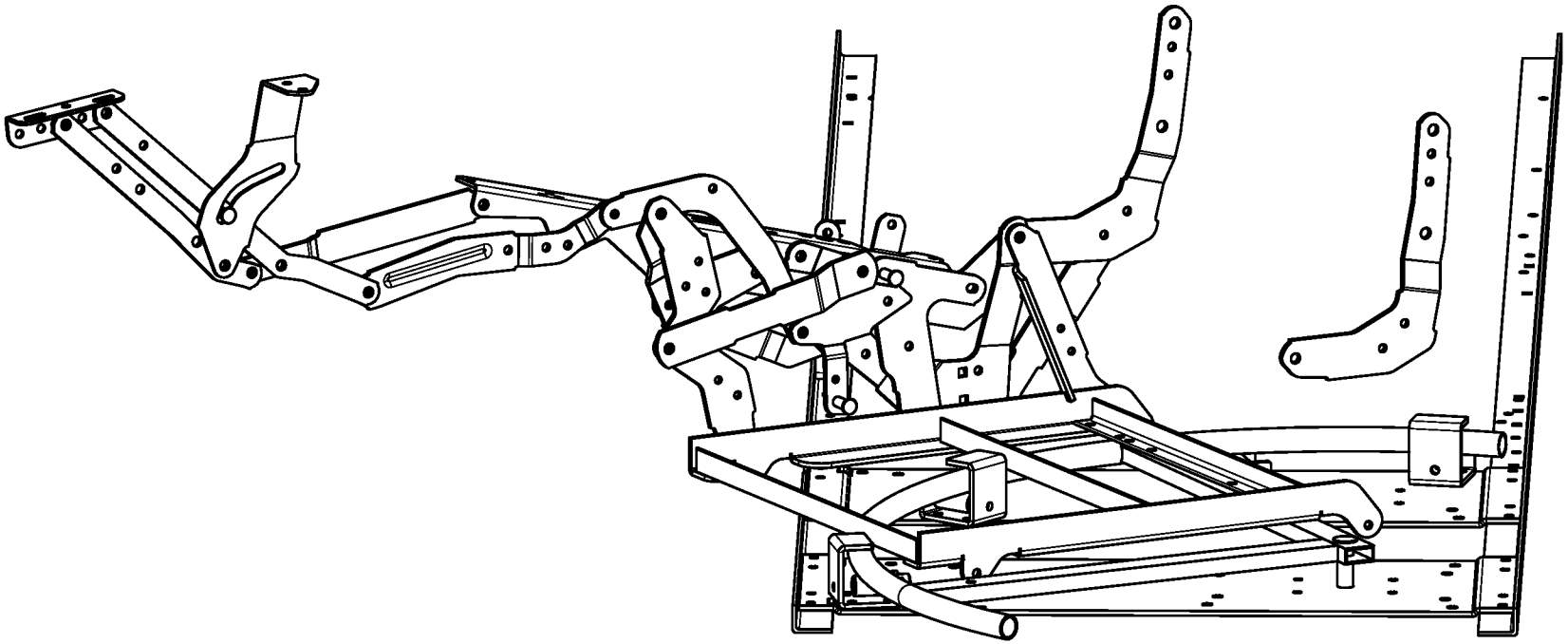
FIG. 8 is another view of the pivot mechanism of FIG. 4.
Figure 9:
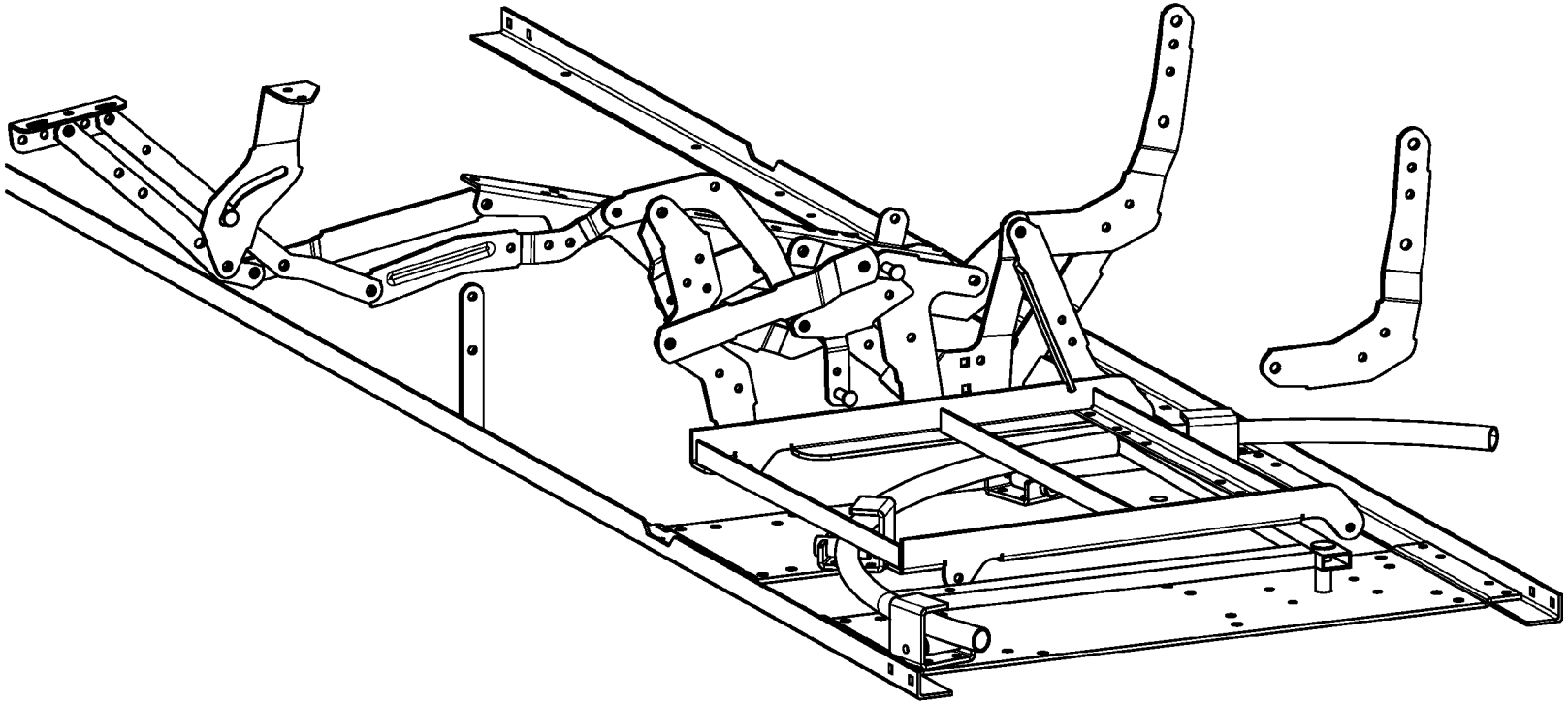
FIG. 9 shows another view of the pivot mechanism of FIG. 4.
Figure 10:
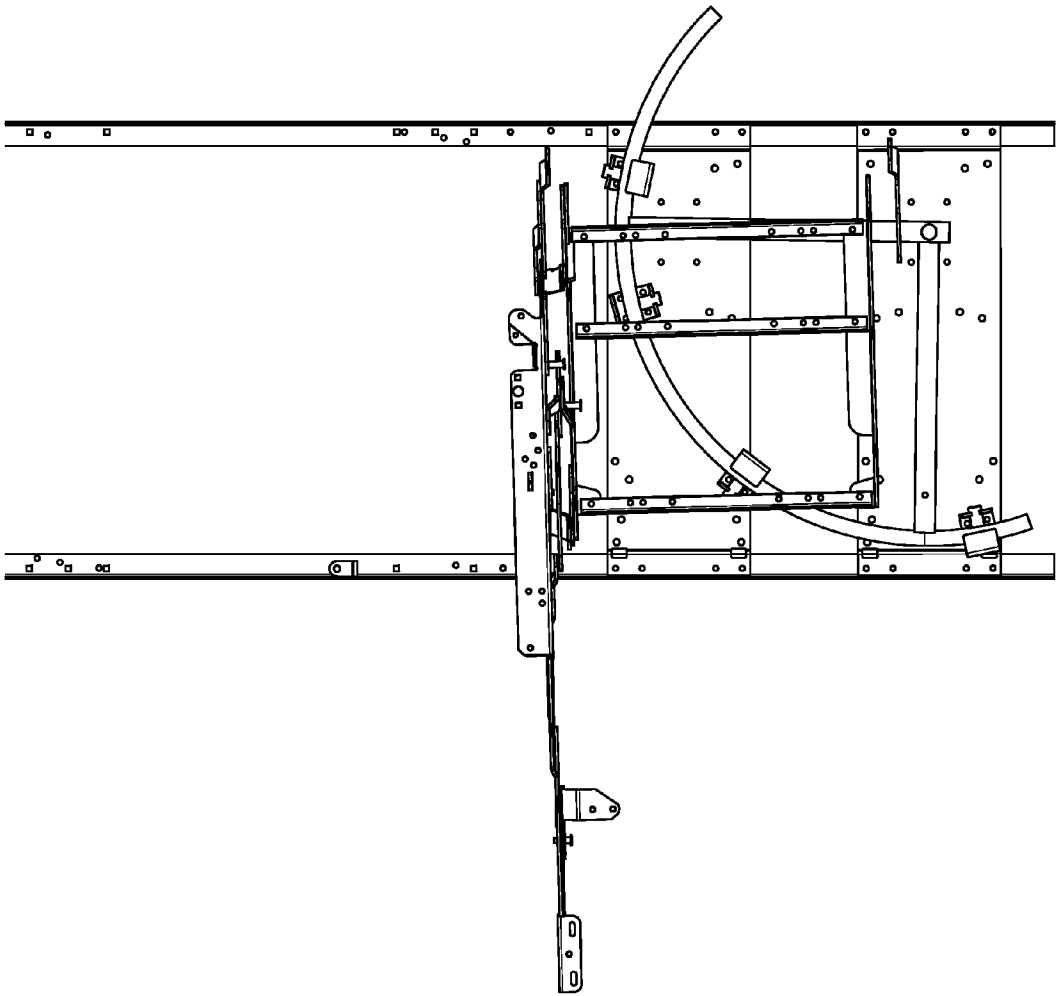
FIG. 10 shows another view of the pivot mechanism of FIG. 4.

FIG. 4 shows one example of an eccentric pivot mechanism that can be used in furniture such as the sectional sofa shown in FIGS. 1-3. The eccentric pivot mechanism shown in FIG. 4 includes a stationary base 18, an eccentric pivot structure 20, and a seat supporting frame 22 (some parts of these and other components and framework of the seating have been omitted from the Figures for clarity). The stationary base 18 includes framework 24 that connects the eccentric pivot mechanism and its associated seat supporting frame 22 and seat to the rest of the components of the furniture. The stationary base 18 provides a place to connect the pivot 26 of the eccentric pivot structure 20 (described further below) and also includes bracket and roller bearing assemblies 28 that provide additional support to the eccentric pivot structure 20, seat supporting frame 22 and its associated seating.

The eccentric pivot structure 20 shown in FIG. 4 includes the aforementioned pivot 26 as well as associated framework 30. The type of pivot 26 may, in appropriate circumstances, be any type of swivel or other suitable structure allowing eccentric pivot structure 20 to rotate relative to stationary base 18, including, without limitation, the swivel plate assembly shown in the Rogers patent (including a smaller-sized version of that swivel plate), other types of swivel plate assemblies, other swivels that may or may not incorporate ball or roller bearings, and other mechanisms and structures that facilitate or guide rotation between the eccentric pivot structure 20 and stationary base 18 (such as, but not limited to, a guide pin around which the eccentric pivot structure 20 rotates).

The pivot 26 shown in FIG. 4 is positioned to impart an eccentric movement to the eccentric pivot structure 20 such that an associated seat (such as seat 10 shown in FIGS. 1-3) will translate outwardly and away from adjacent portions of the furniture as it rotates to a desired position (such as the position of seat 10 shown in FIG. 2) to provide a suitable amount of clearance between the rotating seat and adjacent portions of the furniture. The eccentric rotation of the pivot structure 20 may also be designed to ensure a suitable amount of clearance between the rotating seat and adjacent walls or other structures next to which the furniture is positioned. The precise position of the pivot 26 and other components of this eccentric pivot mechanism can be varied based on the specific geometries of the particular piece of furniture in which the eccentric pivot mechanism will be used and based on other factors. In the example shown in FIGS. 4-10, the pivot 26 is positioned behind and to one side of the center of the seat in which it is incorporated. Specifically, the pivot 26 of FIGS. 4-10 is positioned 5.75 inches from the centerline of the base front to back and 9.5 inches from the centerline of the base side to side. The position of the pivot 26 shown in FIGS. 4-10 is not at the center of gravity of the associated chair at any point throughout the chair's range of motion. Although in some embodiments, the pivot 26 might be positioned at the center of gravity of the chair during some portion of the chair's range of motion.

In some embodiments, including the examples shown in the Figures, it may be desirable to bolster the stability of the eccentric pivot structure 20, since (at least in the examples shown in the Figures) the pivot 26 is offset from the center of gravity of the rotating seat. The eccentric pivot structure 20 shown in FIG. 4 includes a curved support 32 that bolsters its stability. Curved support 32 extends in a partial circle defined by a radius having a fixed length that extends from the pivot 26. Curved support 32 is connected to the pivot 26 by associated framework 30, and pivots along with the rest of the eccentric pivot structure 20. The curved support 32 moves over the roller bearings of assemblies 28 as the eccentric pivot structure 20 pivots. The brackets of the assemblies 28 extend over the top of the curved support 32 and thereby help to prevent the curved support 32 from significantly lifting up off of the roller bearings. Accordingly, assemblies 28 help to keep the seat balanced in use, which can be of particular concern when the seat is pivoted outwardly and the recliner is in full extension (as shown in FIG. 2).

One example of a seat supporting frame 22 (only portions of which are shown) is shown in FIG. 4. Although not specifically shown, seat supporting frame 22 can be connected to or incorporated into eccentric pivot structure 20 in any desired manner. The seat supporting frame 22 shown in FIG. 4 includes a known type of reclining mechanism 34 that will be familiar to those skilled in the art.

FIGS. 5-10 show other views of the eccentric pivot mechanism of FIG. 4, illustrating at least a partial range of motion of the eccentric pivot mechanism as well as showing views of the seat supporting frame 22 extended into a reclined position.

FIGS. 11-19 show another example of an eccentric pivot mechanism. The eccentric pivot mechanism of FIGS. 11-19 includes similar structures and functionalities to the mechanism shown in FIGS. 4-10, but also includes some differences. For instance, FIGS. 11-18 show one example of how the seat supporting frame 22 can be connected to the eccentric pivot structure 20, although other connections are also possible and within the scope of the present invention.

Figure 17:
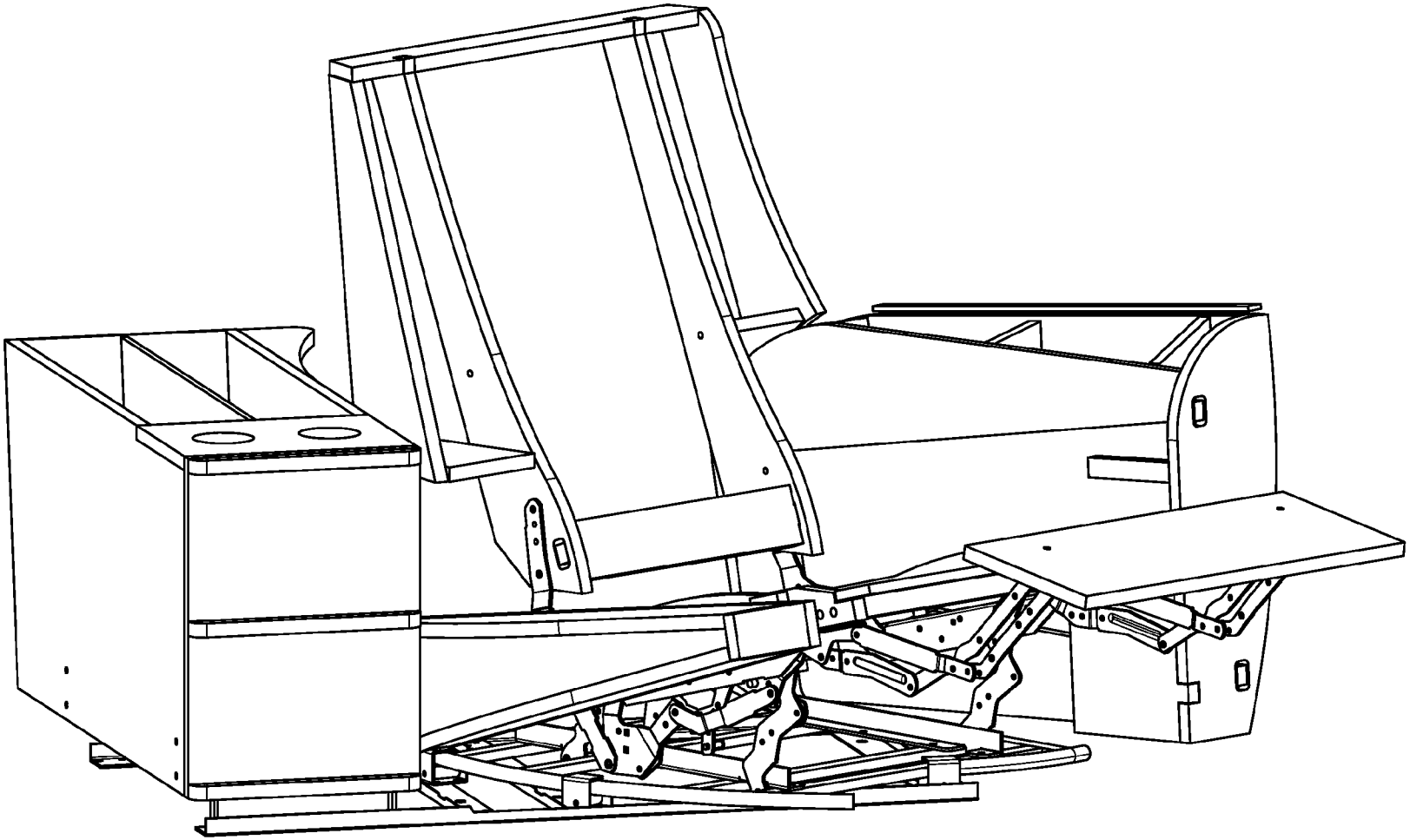
FIG. 17 shows another view of the pivot mechanism of FIG. 11, shown with other components of the furniture in a pivoted position and reclined position.
Figure 18:
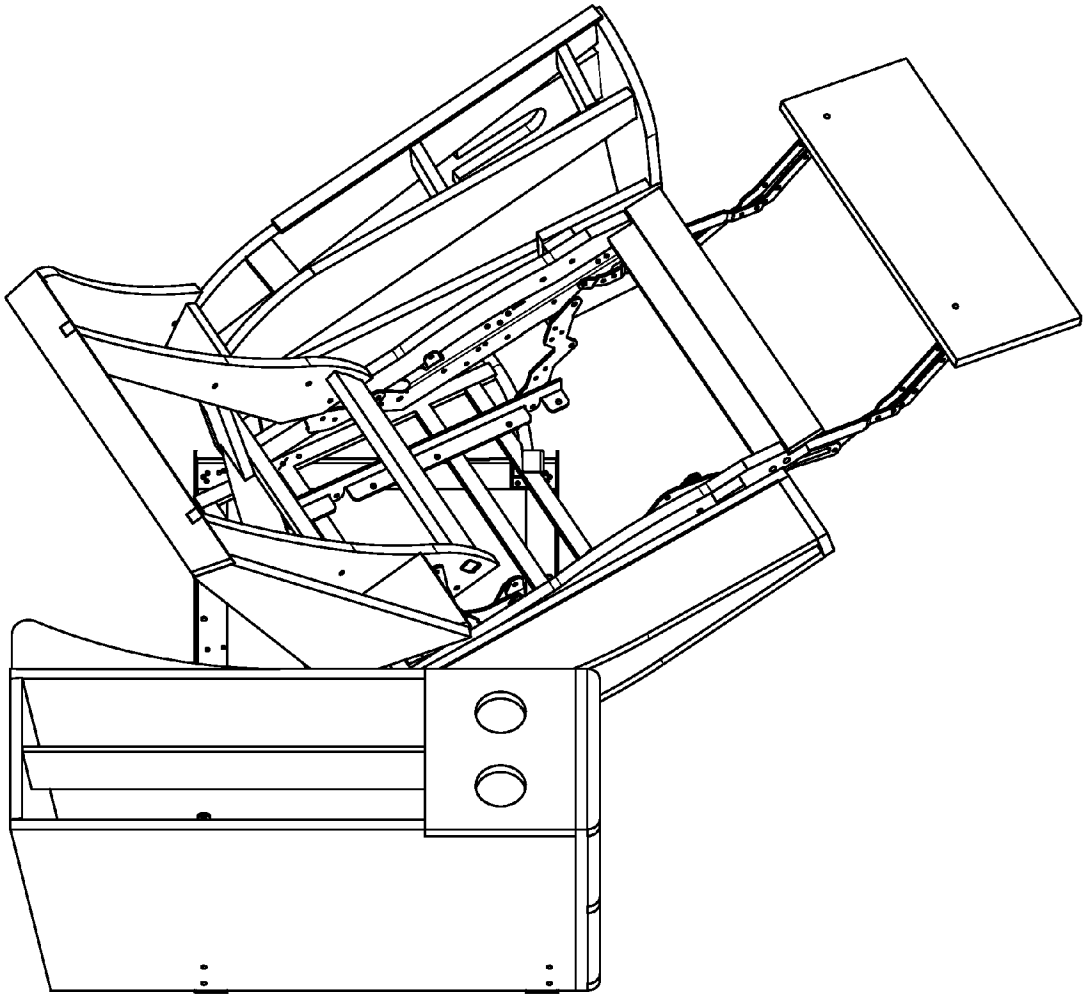
FIG. 18 shows another view of the pivot mechanism of FIG. 11, shown with other components of the furniture in a pivoted position and reclined position.
Figure 19:
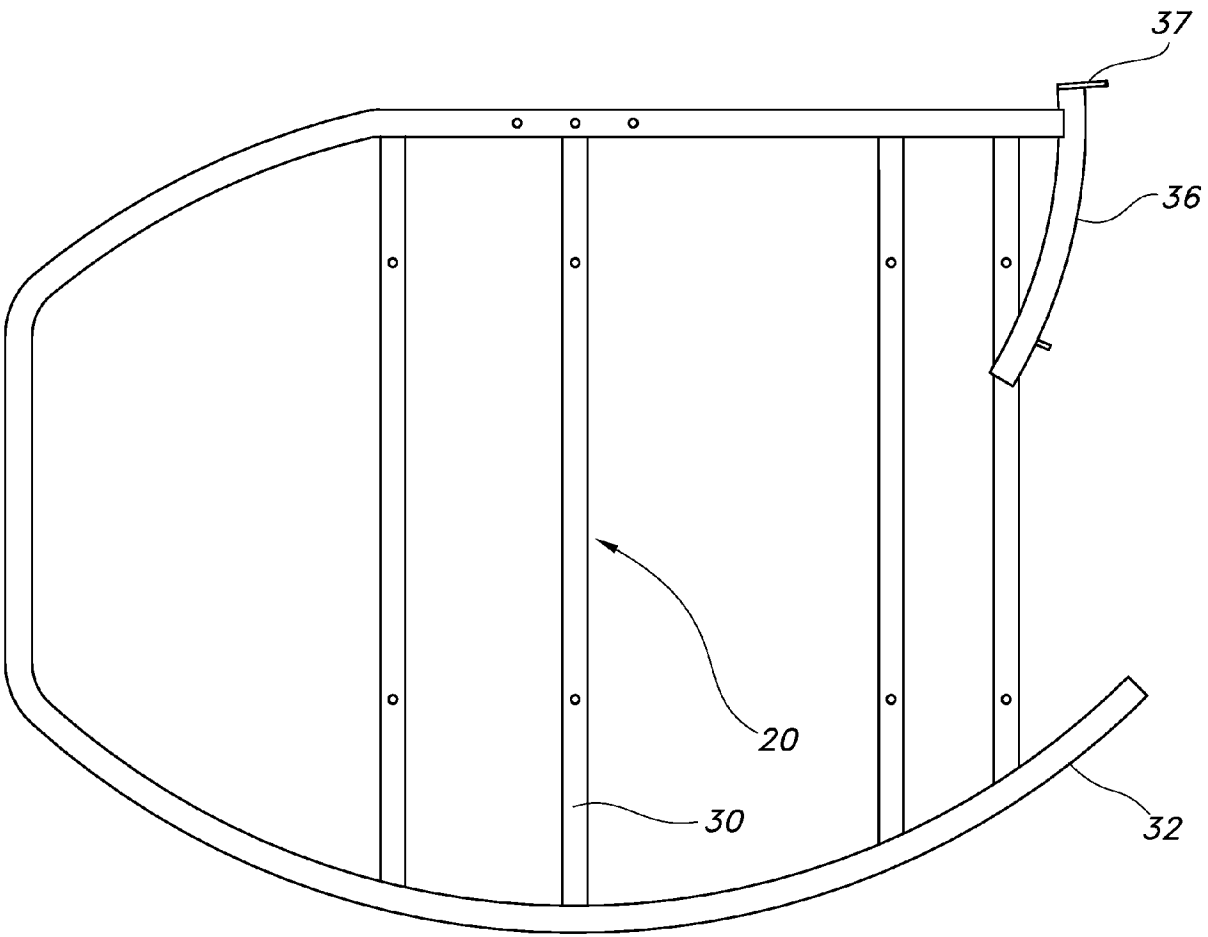
FIG. 19 shows an example of components for a eccentric pivot mechanism.

Another difference between the eccentric pivot mechanism of FIGS. 5-10 and the mechanism of FIGS. 11-19 is that the eccentric pivot structure 20 of the example shown in FIGS. 11-18 includes a second curved support 36. FIG. 19 shows an example of the associated framework 30 of the eccentric pivot structure 20 and curved support 32 of the eccentric pivot mechanism developed by applicant.

In the example shown in FIGS. 11-19, the second curved support 36 provides supplemental support to the eccentric pivot structure 20. The second curved support extends in a partial circle or arc defined by a radius having a fixed length extending from the pivot (which is not specifically shown in FIGS. 11-19). Although the arc along which the second curved support 36 extends is concentric with the arc of first curved support 32, it does not coincide with the arc defined by the first curved support 32, and, at least in the embodiment shown in FIG. 19, is defined by a shorter length of radius of curvature than the first curved support 32.

As shown in FIGS. 11-19, the second curved support 36 also helps to limit the range of motion of the eccentric pivot structure 20. For instance, in the embodiment shown in FIG. 19, the second curved support 36 includes a stop 37 that will contact the bracket of one of the assemblies (not shown) to limit the inward pivoting of the eccentric pivot structure 20. The stop 37 will contact the bracket of one of the assemblies to limit the inward pivoting of the eccentric pivot structure 20. The second curved support 36, and/or other parts of the associated framework 30 of the eccentric pivot structure 20, may also contact the same bracket (or other structures) proximate reference 38 in FIGS. 11 and 19 to limit the outward pivoting of the eccentric pivot structure 20. This may be important in some, but not necessarily all, embodiments, as some specific designs may become more unbalanced as they pivot outwardly, reducing the furniture's stability. In the particular embodiments shown in the Figures, the outward pivot is limited to approximately 35-45 degrees to retain a suitable level of stability.

Figure 11:
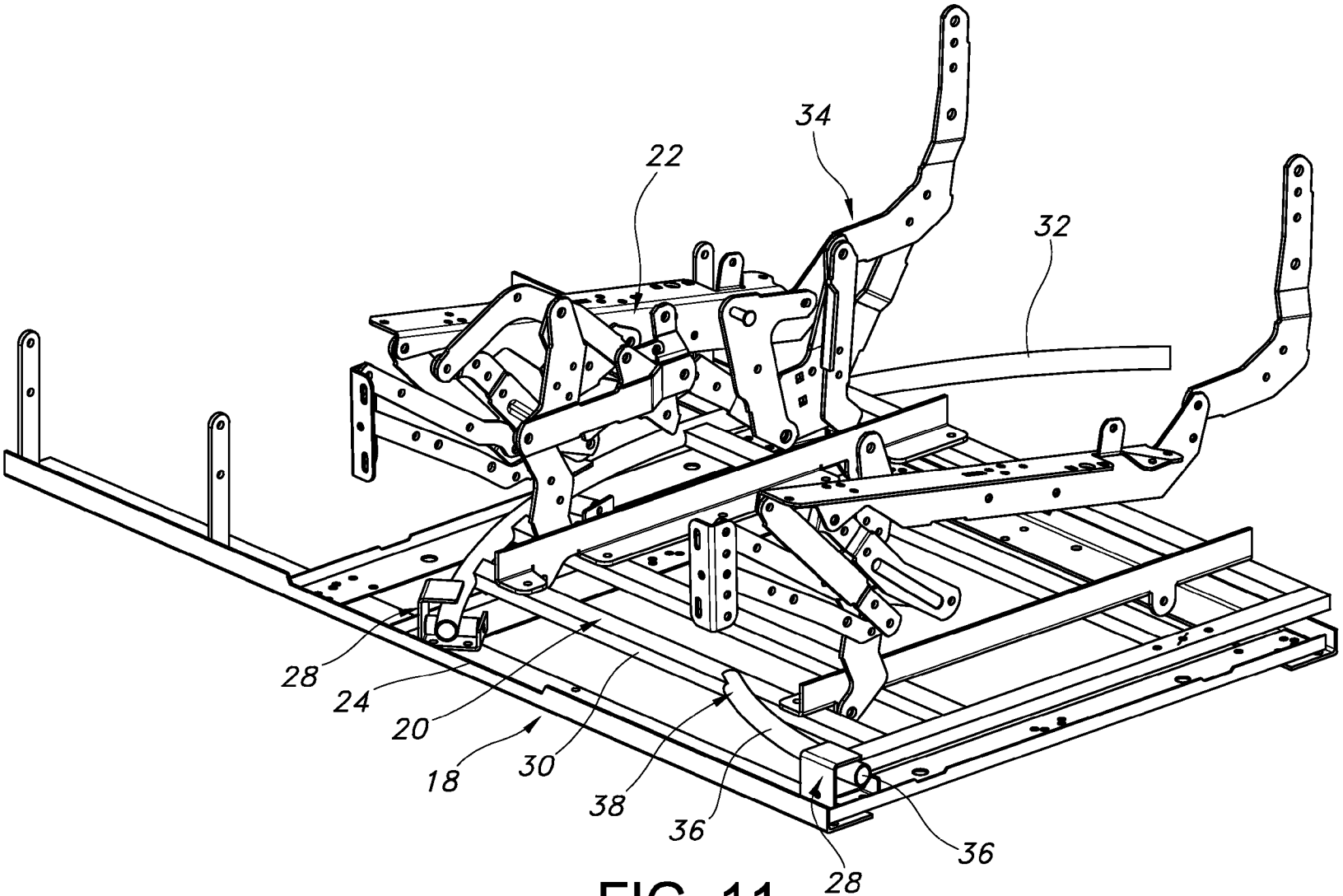
FIG. 11 shows another embodiment of an eccentric pivot mechanism for seating.
Figure 12:
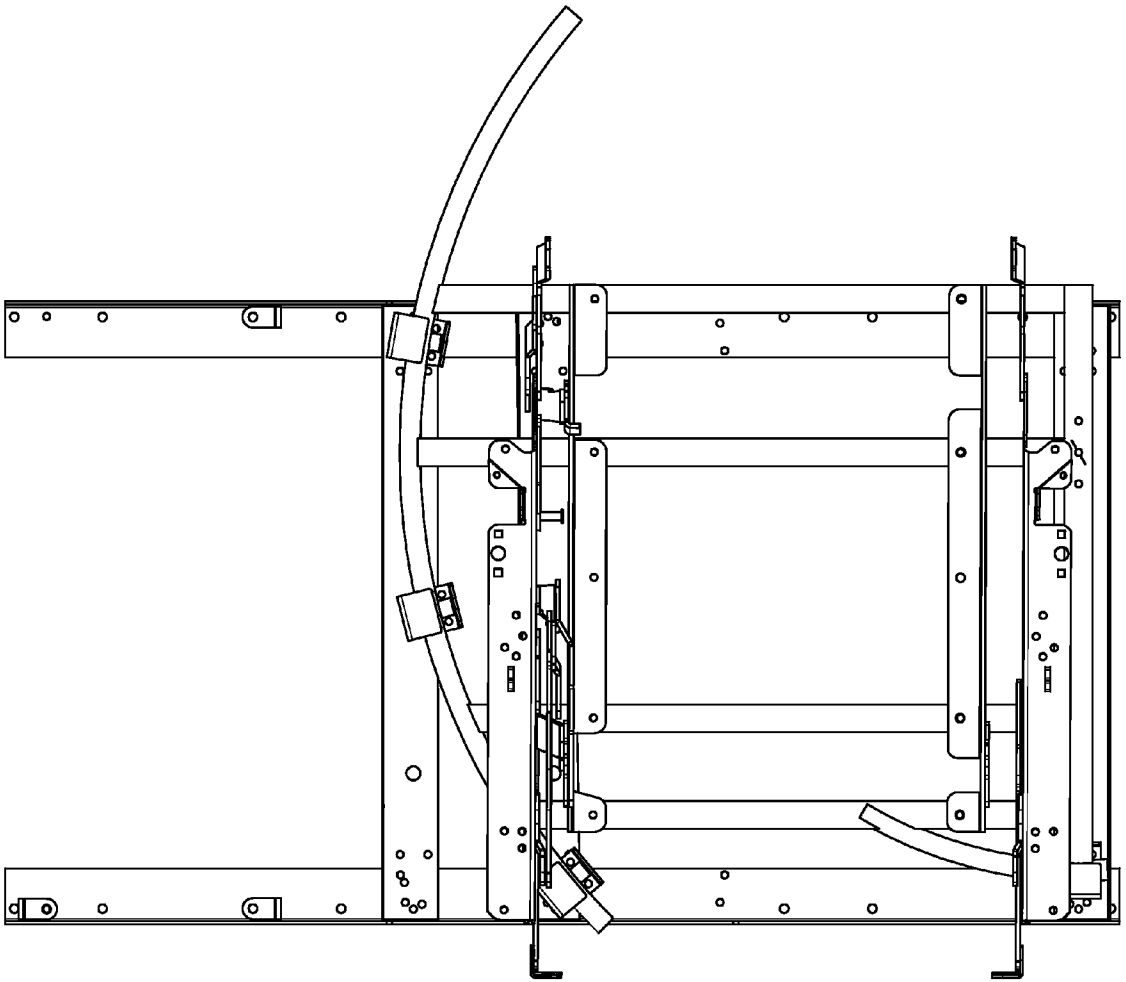
FIG. 12 shows another view of the pivot mechanism of FIG. 11.
Figure 13:
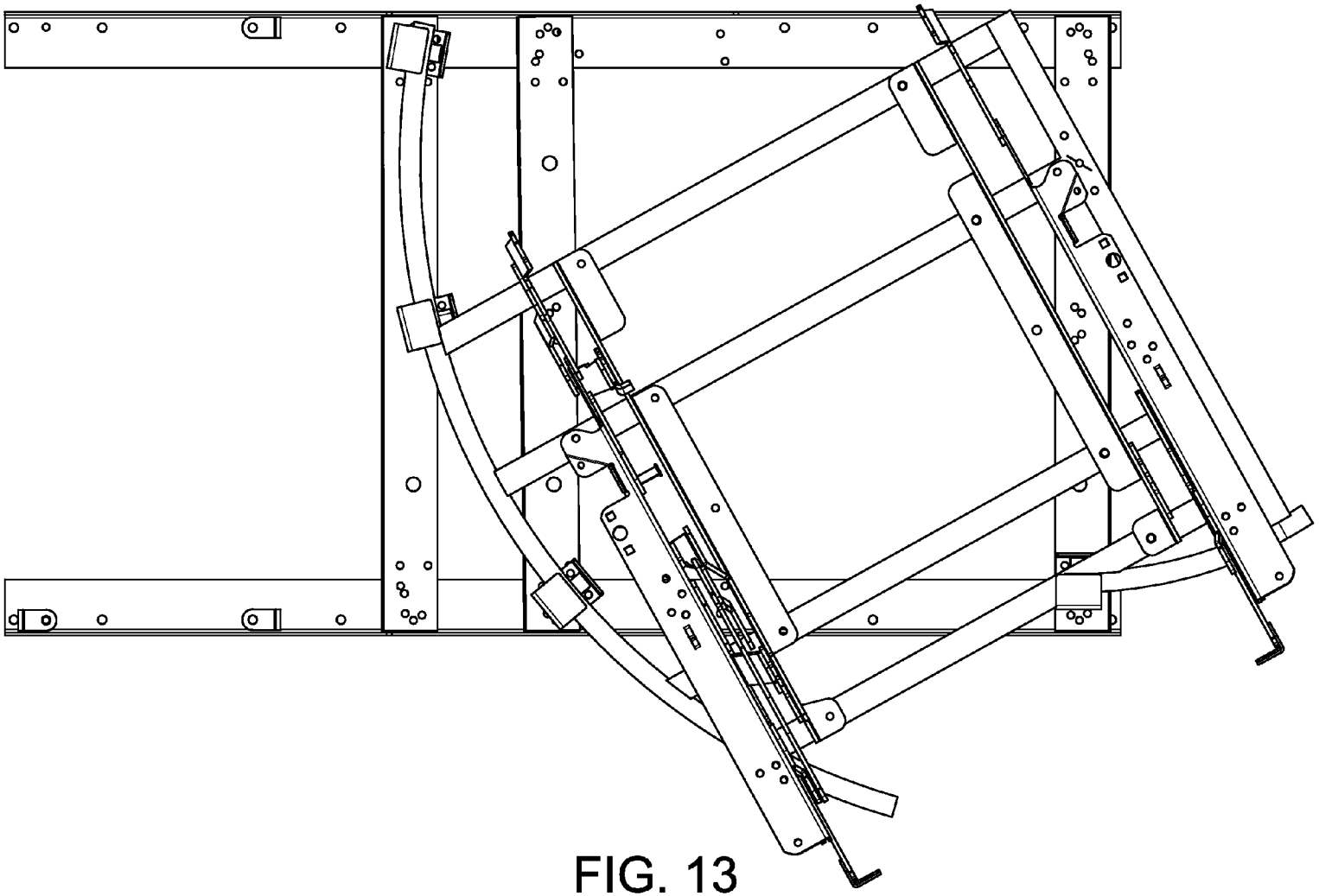
FIG. 13 shows another view of the pivot mechanism of FIG. 11 in a pivoted position.
Figure 14:
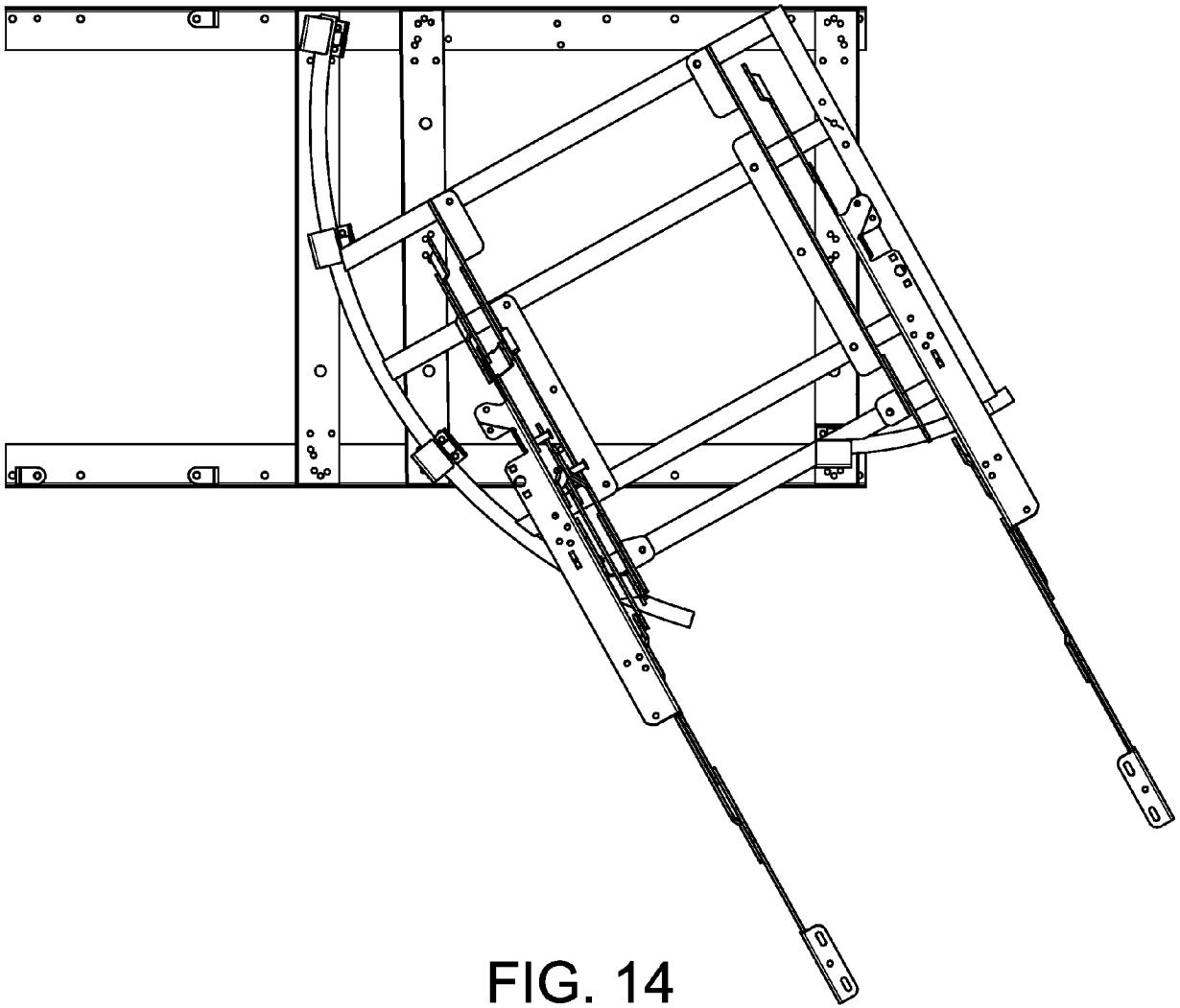
FIG. 14 shows another view of the pivot mechanism of FIG. 11 in a pivoted and reclined position.
Figure 15:
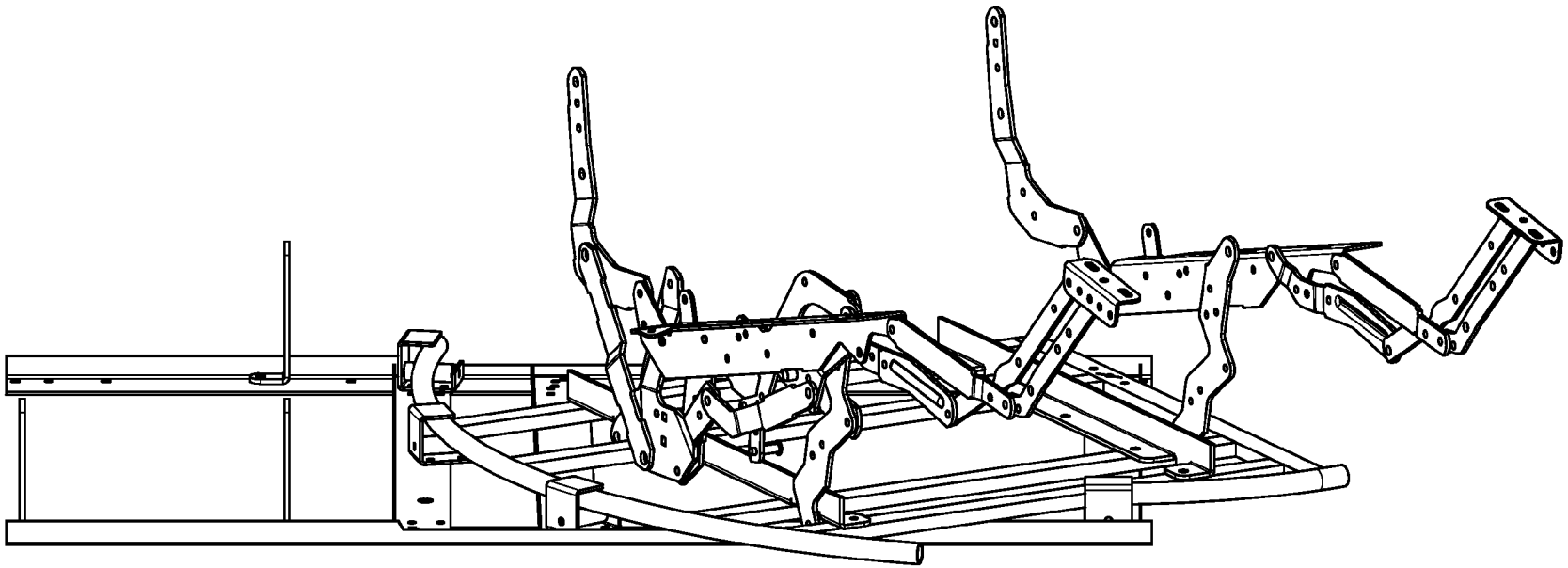
FIG. 15 shows another view of the pivot mechanism of FIG. 11 in a pivoted and reclined position.
Figure 16:
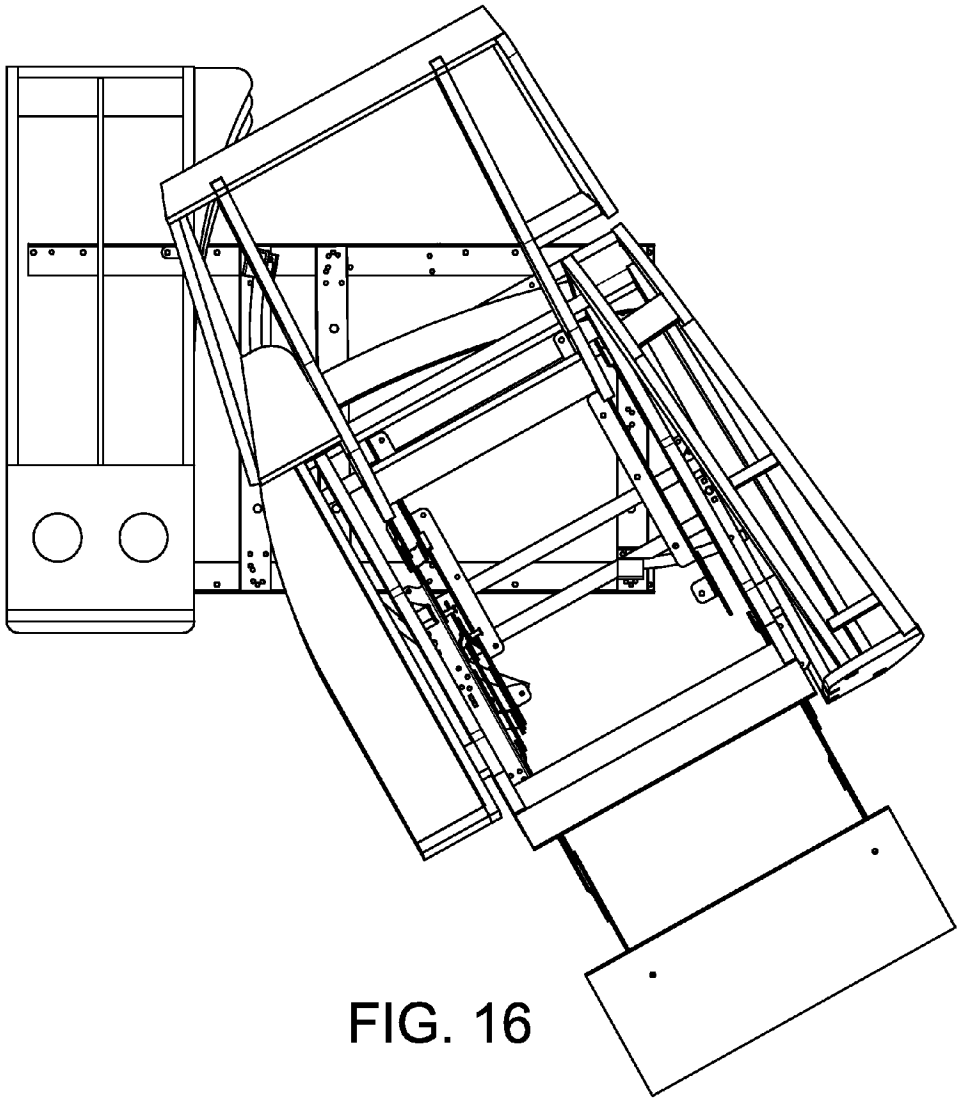
FIG. 16 shows another view of the pivot mechanism of FIG. 11, shown with other components of the furniture in a pivoted position and reclined position.

FIGS. 11-18 show various views of the eccentric pivot mechanism of FIG. 11, illustrating at least a partial range of motion of the eccentric pivot mechanism as well as showing views of the seat supporting frame 22 extended into a reclined position. FIGS. 16-18 also illustrate other framework and other components of the furniture. As shown best in FIGS. 16 and 18, in some instances, it may be necessary to curve some of the framework elements proximate to the junction of the pivoting seat 10 and other elements of the furniture, to provide additional clearance for the seat 10 as it pivots.

In one embodiment, the seating with the eccentric pivot mechanism has a switch to lock the seat in a desired position. A user pulls a cable attached to the seat that unlocks the switch to allow the seat to rotate with respect to the adjacent seating. The switch is locked by a spring mechanism. Pulling the cable depresses the spring and unlocks the switch.

The switch is a position to prevent movement of the seat. In one embodiment, the switch interacts with the curved support, and while in the locked position, does not allow the curved support to rotate with respect to the stationary base. In another embodiment, the locked switch interacts with the seat, and while in the locked position, does not allow the seat to rotate with respect to the curved support. While locked, the switch restricts movement of the seat with respect to other aspects of the furniture.

One of skill in the art will appreciate that additions, deletions, substitutions and other changes can be made to the examples shown and described herein without departing from the scope or spirit of the present invention.

For instance, applicant's new eccentric pivot mechanism could be incorporated into furniture other than the sectional sofa illustrated herein, which may or may not have different components than the furniture shown in the Figures. In some embodiments, the furniture piece would not necessarily include a storage console 14 or other structure separating the pivoting seat 10 from other seating of the furniture piece. Seat supporting frames other than the seat supporting frame 22 shown in the Figures could be employed, and such other seat supporting frames may or may not include moveable components for adjusting orientations or positioning of the seat (e.g. reclining features).

Swivel mechanisms, including the ones shown and described herein or other mechanisms, could also include one or more detents in the underside of curved support 32 and/or 36 so that the rollers will seat in those detents to retain the seat in that rotational position until sufficient rotational force is exerted to move the support 32 and/or 36 beyond the detent. Other mechanisms could also keep the pivoting seat in a desired orientation until the user applies sufficient force to disengage the detent mechanism and cause the seat to pivot.

Alternative mechanisms could be used to support the chair on a base while permitting it to rotate through a desired arc about an off center pivot point. The Figures show a track, or two tracks, that ride on top of fixed rollers. Alternatively, rollers attached to the chair could roll in or on a stationary track; the track, whether stationary or moving, could be a round tube as shown, or a variety of alternative shapes including flat plates, square, oval or rectangular cross-section tubes, and angles and channels, including c-shaped, u-shaped and other shapes of channels. In some of these alternatives, the track could positively guide the movement of the chair, such that a separate pivot 26 would not be necessary.

In some alternative embodiments, different parts of the chair could rotate around different pivot points (whether such pivot points are defined by an actual pivot mechanism 26 or a virtual pivot point) to provide more complex rotational movements.

Eccentric pivot mechanisms within the scope of the present invention could be designed to allow for other directions and magnitudes of pivoting than those shown and described herein.

Eccentric pivot mechanisms within the scope of the present invention could also incorporate linear drive motors or other functionality for automatically adjusting the position and/or orientation of the moveable chair. For instance, in one embodiment, a user could actuate a drive motor (using a hand held or chair mounted control or the like) to automatically swivel the chair, automatically recline the chair, both automatically swivel and recline the chair, or adjust the position and/or orientation of the moveable chair to an intermediate position and/or orientation.

Modifications may be made to the structures and methods recited above and shown in the drawings without departing from the scope or spirit of the invention and the following claims.

The invention claimed is:

1. A sectional sofa comprising:

a. at least two seats wherein:

i. a first seat, the first seat oriented to face in a first direction;

ii. a second seat, the second seat movable between a first position and a second position, wherein, when in the first position, the second seat is oriented to face a second direction, wherein, when in the second position, the second seat is oriented to face a third direction, and wherein the second direction is substantially perpendicular to the first direction and the third direction is not substantially perpendicular to the first direction;

b. wherein the second seat includes an eccentric pivot that facilitates an eccentric rotation of the second seat between the first position and the second position.

2. The sectional sofa of claim 1, wherein the first seat is movable between a first first seat position and a second first seat position.

3. The sectional sofa according to claim 1, in which the second seat comprises a reclining seat back.

4. The sectional sofa according to claim 3, in which, when in the second position, the second seat is oriented to face a similar direction as the first seat.

5. The sectional sofa according to claim 3, further comprising a stop for limiting the eccentric rotation of the second seat to less than approximately 45 degrees between the first position and the second position.

6. The sectional sofa according to claim 1, in which the eccentric pivot is offset relative to both front to rear and side to side axes of the second seat, and is offset from a center of gravity of the second seat throughout a range of motion of the second seat.

7. The sectional sofa according to claim 1, further comprising at least one curved support fixably attached to the second seat, the curved support extending in a partial circle defined by a radius having a fixed length extending from the eccentric pivot.

8. The sectional sofa according to claim 7, in which the curved support is rotatably attached to the eccentric pivot allowing the curved support to rotate around the eccentric pivot.

9. The sectional sofa according to claim 7, in which the curved support moves along a bracket assembly, the bracket assembly positioned to constrain an undesired movement of the second seat.

10. The sectional sofa according to claim 9, in which the bracket assembly comprises one or more stops for limiting an eccentric rotation of the curved support so that the second seat pivots less than approximately 45 degrees between the first position and the second position.

11. The sofa according to claim 9, in which the bracket assembly comprises brackets which prevent the curved support from elevating off a plurality of ball or roller bearings that guide rotation of the curved support.

12. The sectional sofa according to claim 7, in which the curved support comprises one or more detents located on the underside of the curved support so that a plurality of roller bearings will settle in those detents to retain the second seat in a particular rotational position until sufficient rotational force is exerted to disengage the detent and cause the second seat to pivot.

13. A sofa comprising:

a. a first seat;

b. a second seat connected to the first seat, the second seat including:

i. a seat supporting frame;

ii. a seat base;

iii. an eccentrically positioned pivot structure connecting the seat supporting frame to the seat base, such that the seat supporting frame can eccentrically rotate with respect to the seat base; and iv. a curved support for supporting the seat supporting frame as it eccentrically rotates with respect to the seat base.

14. The sofa according to claim 13, in which the seat base is stationary with respect to the first seat.

15. The sofa according to claim 13, in which the second seat comprises a reclining seat back.

16. The sofa according to claim 15, in which the second seat further comprises a bracket assembly positioned to constrain undesired movement of the seat supporting frame, the bracket assembly comprising:

a. one or more stops for limiting the eccentric rotation of the second seat to less than approximately 45 degrees between a first position and a second position;

b. ball or roller bearings that guide the rotation of the curved support; and c. brackets which prevent the curved support from elevating off the ball or roller bearings.

17. The sofa according to claim 13, in which the eccentrically positioned pivot structure is offset relative to both front to rear and side to side axes of the second seat, and is offset from a center of gravity of the second seat throughout a range of motion of the second seat.

18. A sectional sofa comprising:

a. at least two seats wherein:

i. a first seat, the first seat oriented to face in a first direction;

ii. a second seat, the second seat movable between a first position and a second position, wherein, when in the first position, the second seat is oriented to face a second direction, wherein, when in the second position, the second seat is oriented to face a third direction, and wherein the second direction is substantially perpendicular to the first direction and the third direction is not substantially perpendicular to the first direction, the second seat comprising a reclining second seat, the reclining second seat including:

1. a seat supporting frame;

2. a seat base;

3. an eccentrically positioned pivot connecting the seat supporting frame to the seat base, such that the seat supporting frame can eccentrically rotate with respect to the seat base;

iii. wherein the second seat further comprises:

1. a curved support for supporting the seat supporting frame as it eccentrically rotates with respect to the seat base between the second direction and the third direction;

2. a bracket assembly positioned to constrain an undesired movement of the second seat.

19. The sectional sofa of claim 18, wherein the first seat is movable between a first first seat position and a second first seat position.

20. The sectional sofa according to claim 18, in which the second seat comprises a reclining seat back.

21. The sectional sofa according to claim 20, in which, when in the second position, the second seat is oriented to face a similar direction as the first seat.

22. The sectional sofa according to claim 20, further comprising a stop for limiting the eccentric rotation of the second seat to less than approximately 45 degrees between the first position and the second position.

23. The sectional sofa according to claim 20, in which the eccentrically positioned pivot is offset relative to both front to rear and side to side axes of the second seat, and is offset from a center of gravity of the second seat throughout a range of motion of the second seat.

24. The sectional sofa according to claim 18, in which the curved support extends in a partial circle defined by a radius having a fixed length extending from the eccentrically positioned pivot.

25. The sectional sofa according to claim 24, in which the curved support is rotatably attached to the eccentrically positioned pivot allowing the curved support to rotate around the eccentrically positioned pivot.

26. The sectional sofa according to claim 24, in which the curved support comprises one or more detents.

27. The sectional sofa according to claim 26, in which the detents are located on the underside of the curved support so that a plurality of roller bearings will settle in those detents to retain the second seat in a particular rotational position until sufficient rotational force is exerted to disengage the detent and cause the second seat to pivot.

28. The sectional sofa according to claim 24, in which the bracket assembly comprises ball or roller bearings that guide rotation of the curved support.

29. The sectional sofa according to claim 24, in which the bracket assembly comprises brackets which prevent the curved support from elevating off a plurality of ball or roller bearings.

30. The sectional sofa according to claim 24, in which the bracket assembly comprises one or more stops for limiting the eccentric rotation of the curved support so that the second seat pivots less than approximately 45 degrees between the first position and the second position.

31. The sectional sofa according to claim 24, further comprising a second curved support, the second curved support comprising a partial circle defined by a radius having a fixed length extending from the eccentrically positioned pivot.

32. The sectional sofa according to claim 31, in which the second curved support provides supplemental support to the second seat and limits the range of motion of the eccentrically positioned pivot.

* * * * *